US006233419B1

(12) United States Patent
Chigono et al.

(10) Patent No.: US 6,233,419 B1
(45) **Date of Patent: *May 15, 2001**

(54) CHARGING DEVICE AND IMAGE FORMING APPARATUS

(75) Inventors: Yasunori Chigono, Susono; Harumi Ishiyama; Jun Hirabayashi, both of Numazu, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/151,297

(22) Filed: Sep. 11, 1998

(30) Foreign Application Priority Data

| | | |
|---|---|---|
| Sep. 11, 1997 | (JP) | 9-264920 |
| Oct. 28, 1997 | (JP) | 9-311219 |
| May 14, 1998 | (JP) | 10-150611 |
| May 14, 1998 | (JP) | 10-150617 |

(51) Int. Cl.[7] ..... G03G 15/02
(52) U.S. Cl. ..... 399/176; 399/174
(58) Field of Search ..... 399/50, 168, 174, 399/175, 176, 272, 281

(56) References Cited

U.S. PATENT DOCUMENTS

| | | | | |
|---|---|---|---|---|
| 5,351,109 | * | 9/1994 | Haneda | 399/175 |
| 5,365,318 | * | 11/1994 | Hiraoka et al. | 399/281 X |
| 5,367,365 | * | 11/1994 | Haneda et al. | 399/174 |
| 5,381,215 | * | 1/1995 | Haneda et al. | 399/174 |
| 5,426,489 | * | 6/1995 | Haneda et al. | 399/175 |
| 5,432,033 | * | 7/1995 | Asanae et al. | 399/176 X |
| 5,592,264 | * | 1/1997 | Shigeta et al. | 399/175 |
| 5,606,401 | * | 2/1997 | Yano | 399/175 |
| 5,666,192 | * | 9/1997 | Mashimo et al. | 399/174 |
| 5,724,632 | * | 3/1998 | Arahira et al. | 399/174 |
| 5,781,838 | * | 7/1998 | Suzuki | 399/272 X |
| 5,822,659 | * | 10/1998 | Ishiyama | 399/175 |

FOREIGN PATENT DOCUMENTS

| | | |
|---|---|---|
| 5-150539 | 6/1993 | (JP) . |
| 6-3921 | 1/1994 | (JP) . |
| 7-99442 | 4/1995 | (JP) . |

* cited by examiner

*Primary Examiner*—Sandra Brase
(74) *Attorney, Agent, or Firm*—Fitzpatrick, Cella, Harper & Scinto

(57) ABSTRACT

A charging apparatus includes a movable charging member for being supplied with a voltage to charge a member to be charged, said charging member being provided with a flexible member for forming a nip with the member to be charged, wherein a speed difference is provided between surfaces of the member to be charged and said flexible member; electroconductive particles supplying means, having a foam member contactable to said charging member, for supplying electroconductive particles to said charging member to provide the nip with the electroconductive particles.

25 Claims, 8 Drawing Sheets

CHARGING DEVICE AND IMAGE FORMING APPARATUS

FIELD OF THE INVENTION AND RELATED ART

The present invention relates to a charging device for electrically charging a member to be charged. More particularly, it relates to a charging device for charging a surface of the member to be charted by a flexible charging member which cooperates with the member to be charged to form a nip therebetween.

Furthermore, it relates to an image recording device (image forming apparatus) such as a copying machine, a printer or the like using such a charging device as charging means for an image bearing member.

Heretofore, a corona type charger (corona discharging device) has been widely used as a charging apparatus for charging (inclusive of discharging) an image bearing member (member to be charged) such as an electrophotographic photosensitive member or an electrostatic dielectric recording member to a predetermined polarity and a predetermined potential level in an image forming apparatus, for example, an electrophotographic apparatus or an electrostatic recording apparatus.

The corona type charging device is a non-contact type charging device, and comprises a corona discharging electrode such as a wire electrode, and a shield electrode which surrounds the corona discharging electrode. It is disposes so that corona discharging opening thereof faces an image bearing member, that is, a member to be charted. In usage, the surface of an image bearing member is charged to a predetermined potential level by being exposed to discharge current (corona shower) generated as high voltage is applied between the corona discharging electrode and the shield electrode.

Recently, it has been proposed to employ a contact type charging apparatus as a charging apparatus for charging the image bearing member, that is, the member to be charged, in an image forming apparatus of low to medium speed. This is due to the fact that contact type charging apparatus has an advantage over a corona type charging apparatus in terms of low ozone production, low power consumption, or the like. Also, such a contact type charging apparatus has been put to practical use.

In order to charge a member such as an image bearing member with the use of a contact type charging apparatus, the electrically conductive charging member (contact type charging member, contact type charging device, or the like) of a contact type apparatus is placed in contact with eh member to be charged, and an electrical bias (charge bias) of a predetermined level is applied to this contact type charging member so that surface of the member to be charged is charged to a predetermined polarity and a predetermined potential level. The charging member is available in various forms, for example, a roller type (charger roller), a fur brush type, a magnetic brush type, a blade type, and the like.

When a member is electrically charged by a contact type charging member, two types of charging mechanisms (charging mechanism or charging principle: (1) corona charging mechanism and (2) direct charging mechanism, both come into action. Thus, the characteristics of each of contact type charging apparatuses or methods are determined depending on which charging mechanism is the dominant.

(1) Electrical discharge based charging type or mechanism.

With this mechanism, the surface of the member to be charged is charged by the discharge development occurring in the small gap between the contact charging member and the member to be charged.

In the case of the electrical discharge based charging mechanism, there is a threshold voltage which must be surpassed by the charge bias applied to a contact type charging member before electrical discharge occurs between a contact type charging member and a member to be charged, and therefore, in order for the member to be charged through the electrical discharge based charging mechanism, it is necessary to apply to the contact type charging member a voltage with a value greater than the value of the potential level to which the member is to be charged. Thus, in principle, when the electrical discharge based charging mechanism is in action, the discharge product is unavoidable, that is, active ions such as ozone ions are produced, even through the amount thereof is remarkably small.

(2) direct charging system (direction injection charging mechanism)

This is a mechanim in which the surface of a member to be charged is charged by electrical charge directly injecting into the member to be charged, with the use of a contact type charging member. Thus, this mechanism is called "direct charging mechanism", or "charge injection mechanism".

More specifically, a contact type charging member with medium electrical resistance is placed in contact with the surface of a member to be charged to directly inject electrical charge into the surface portion of the member to be charged, without relying on electrical discharge, in other words, without using electrical discharge in principle. Therefore, even if the value of the voltage applied to a contact type charging member is below the discharge starting voltage value, the member to be charged can be charged to a voltage level which is substantially the same as the level of the voltage applied to the contact type charging member. This direct injection charging mechanism does not suffer from the problems caused by the by-product of electrical discharge since it is not accompanied by ozone production.

However, in the case of this charging mechanism, the state of the contact between a contact type charging member and a member to be charged greatly affects the manner in which the member is charged, since this charging mechanism is such a mechanism that directly charges a member. Thus, this direct injection charging mechanism should comprise a contact type charging member composed of high density material, and also should be given a structure which provides a large speed difference between the charging member and the object to be charged, so that given point on the surface of the object to be charged makes contact with a larger are of the charging member.

A) Charging apparatus with charger roller

In the case of a contact type charging apparatus, a roller charge system, that is, a charging system which employs an electrically conductive roller (charge roller) as a contact type charging member, is widely used because of its desirability in terms of safety.

As for the charging mechanism in this roller charge system, the aforementioned (1) charging mechanism, which discharges electrical charge, is dominant.

The charging roller comprises a rubber material or foam member having an electroconductivity or an intermediate resistance. In some charge rollers, the rubber or foamed material is layered to obtain a specific characteristic.

In order to maintain stable contact between a charge roller and an object to be charged (hereinafter, "photosensitive member"), a charge roller is given elasticity, which in turn increases frictional resistance between the charge roller and the photosensitive member. Also in many cases, a charge roller is rotated by the rotation of a photosensitive drum, or is individually driven at a speed slightly different from that of the photosensitive drum. As a result, problems occur: absolute charging performance declines, the state of the contact between the charge roller and the photosensitive drum becomes less desirable, and foreign matter adheres to the charge roller and/or the photosensitive member. With conventional charging roller, the dominant charging mechanism through which a roller charging member charged a member to be charged was a corona charging mechanism.

FIG. 4 is a graph which shows an example of efficiency in contact type charging. In the graph, the abscissas represents the bias applied to a contact type charging member, and the axis of ordinate represents the potential levels correspondent to the voltage values of the bias applied to the contact type charging member.

The characteristics of the conventional charging by a roller are represented by a line designated by a character A. According to this line, when a charge roller is used to charge an object, the charging of an object occurs in a voltage range above an electric discharge threshold value of approximately −500 V. Therefore, generally, in order to charge a member to a potential level of −500 V with the use of a charge roller, either a DC voltage of −1, 000 V is applied to the charge roller, or an AC voltage with a peak-to- peak voltage of 1, 200 V, in addition to a DC voltage of −500 V, is applied to the charge roller to keep the difference in potential level between the charge roller and the member to be charged, at a value greater than the electric discharge threshold value, so that potential of the photosensitive drum converges to the desired potential level.

More specifically, in order to charge a photosensitive drum with a 25 microns thick organic photoconductor layer by pressing a charge roller upon the photosensitive member, charge bias with a voltage value of approximately 640 V or higher should be applied to the charge roller. Where the value of the charge bias is approximately 640 V or higher, the potential level at the surface of the photosensitive member is proportional to the level of the voltage applied to the charge roller; the relationship between the potential level and the voltage applied to the charge roller is linear. This threshold voltage is defined as a charge start voltage $V_{th}$.

In other words, in order to charge the surface of a photosensitive member to a potential level of Vd which is necessary for electrophotography, a DC voltage of (Vd+Vth), which is higher than the voltage level to which the photosensitive member is to be charged, is necessary. Hereinafter, the above described charging method in which only DC voltage is applied to a contact type charging member to charge a member will be called "DC charging method".

However, with the use of the DC charging method, it was difficult to bring the potential level of a photosensitive member exactly to a target level, since the resistance value of a contact charging member changed due to changes in ambience or the like, and also the threshold voltage Vth changed as the photosensitive member was shaved away.

As for a counter measure for the above described problem, Japanese Laid-Open Patent Application No. 149, 669/1998 disclosed an invention which deals with the above problem to effect more uniform charging of a photosensitive member. According to this invention, a "AC charging method" is employed, in which a compound voltage composed of a DC component equivalent to a desired potential level Vd, and an AC component with a peak-to-peak voltage which is twice the threshold voltage Vth, is applied to a contact type charging member. This is intended to utilize the averaging effect of alternating current. That is, the potential of a member to be charged is caused to coverge to the Vd, that is, the center of the peaks of the AC voltage, without being affected by external factors such as operational ambience.

However, even in the case of the contact type charging apparatus in the above described invention, the principal charging mechanism is a charging mechanism which used electrical discharge from a contact type charging member to a photosensitive member. Therefore, as already described, the voltage applied to the contact type charging member needs to have a voltage level higher than the voltage level to which the photosensitive member is to be charged. Thus, ozone is generated, although only in a small amount.

Further, when Ac current is used so that member is uniformly charged due to the averaging effect of AC current, the problems related to AC voltage become more conspicuous. For examples, more ozone is generated; noises traceable to the vibration of the contact type charging member and photosensitive drum caused by the electric field of AC voltage increase; the deterioration of the photosensitive member surface caused by electrical discharge increases, which add to the prior problems.

B) Charging apparatus with fur brush

In the case of this charging apparatus, a charging member (fur brush type charging device) with a brush portion composed of electrically conductive fiber is employed as the contact type charging member. The brush portion composed of electrically conductive fiber is placed in contact with a photosensitive member as a member to be charged, and a predetermined charge bias is applied to the charging member to charge the peripheral surface of the photosensitive member to a predetermined polarity and a predetermined potential level.

Also in the case of this charging apparatus with a fur brush, the dominant charging mechanism is the electrical discharge based charging mechanism.

It is known that there are two type of fur brush type charging devices: a fixed type and a roller type. In the case of the fixed type, fiber with medium electrical resistance is woven into foundation cloth to form pile, and a piece of this pile is adhered to an electrode. In the case of the rotatable type, the pile is wrapped around a metallic core. In terms of fiber density, pile with a density of 100 fiber/mm$^2$ can be relatively easily obtained, but the density of 100 fiber/mm$^2$ is not sufficient to create a state of contact which is satisfactory to charge a member by direct charging. Further, in order to give a photosensitive member satisfactorily uniform charge by the direct charging, velocity difference which is almost impossible to attain with the use of a mechanical structure must be established between a photosensitive drum and a roller type fur brush. Therefore, the fur brush type charging device is not practical.

The relationship between the DC voltage applied to a fur brush type charging member and the potential level to which a photosensitive member is charged by the DC voltage applied to the fur bush shows a characteristic represented by a line B in FIG. 5. As is evident from the graph, also in the case of the contact type charging apparatus which comprises a fur brush, whether the fur brush is of the fixed type or the roller type, the photosensitive member is charged mainly through electrical discharge triggered by applying to the fur brush a charge bias the voltage level of which is higher than the potential level desired for the photosensitive member.

C) Magnetic brush type charging apparatus

A charging apparatus of this type comprises a magnetic brush portion (magnetic brush based charging device) as the contact type charging member. A magnetic brush is constituted of electrically conductive magnetic particles magnetically confined in the form of a brush by a magnetic roller or the like. This magnetic brush portion is placed in contact with a photosensitive member as a member to be charged, and a predetermined charge bias is applied to the magnetic brush to charge the peripheral surface of the photosensitive member to a predetermined polarity and a predetermined potential level.

In the case of this magnetic brush type charging apparatus, the dominant charging mechanism is the charge injection mechanism (2).

As for the material for the magnetic brush portion, electrically conductive magnetic particles, the diameters of which are in a range of 5–50 microns, are used. With the provision of sufficient difference in peripheral velocity between a photosensitive drum and a magnetic brush, the photosensitive member can be uniformly charged through charge injection.

In the case of a magnetic brush type charging apparatus, the photosensitive member is charged to a potential level which is substantially equal to the voltage level of the bias applied to the contact type charging member, as shown by a line C in FIG. 4.

However, a magnetic brush type charging apparatus also has its own problems. For example, it is complicated in structure. Also, the electrically conductive magnetic particles which constitute the magnetic brush portion become separated from the magnetic brush and adhere to a photosensitive member.

Japanese Patent Publication Application No. 3, 921/1994 discloses a contact type charging method, according to which a photosensitive member is charged by injecting electric charge into the charge injectable surface layer thereof, more specifically, into the traps or electrically conductive particles in the charge injectable surface layer. Since this method does not rely on electrical discharge, the voltage level necessary to charge the photosensitive member to a predetermined potential level is substantially the same as the potential level to which the photosensitive member is to be charge, and in addition, no ozone is generated. Further, since AC voltage is not applied, there is no noise traceable to the application of AC voltage. In other works, a magnetic brush type charging system is an excellent charging system superior to the roller type charging system in terms of ozone generation and power consumption, since it does not generate ozone, and uses far less power compared to the roller type charging system.

D) Toner recycling process (cleanerless system)

In a transfer type image forming apparatus, the toner which remains on the peripheral surface of a photosensitive member (image bearing member) after image transfer is removed by a cleaner (cleaning apparatus) and becomes waste toner. Not only for obvious reasons, but also for environmental protection, it is desirable that waste toner is not produced. Thus, image forming apparatuses capable of recycling toner has been developed. In such an image forming apparatus, a cleaner is eliminated, and the toner which remains on the photosensitive member after image transfer is removed from the photosensitive drum by a developing apparatus; the residual toner on the photosensitive member is recovered by a developing apparatus at the same time as a latent image on the photosensitive drum is developed by the developing apparatus, and then is reused for development.

More specifically, the toner which remains on a photosensitive member after image transfer is recovered by fog removal bias (voltage level difference Vback between the level of the DC voltage applied to a developing apparatus and the level of the surface potential of a photosensitive member) during the following image transfer. According to this cleaning method, the residual toner is recovered by the developing apparatus and is sued for the following image development and thereafter; the waste toner is eliminated. Therefore, the labor spent for maintenance is reduced. Further, being cleanerless is quite advantageous in terms of space, allowing image forming apparatuses to be substantially reduce in size.

In a toner recycling system, the untransferred toner is not removed from photosensitive member surface by a cleaner provided exclusively therefor, but is fed to the developing device passing by the charging means portion, and then is reused for the development process again, and therefore, in the case that contact charging is used as the charging means for the photosensitive member, the toner which is insulative exists in the contact portion between the contact charging member and the photosensitive member. In this case, there arises a problem of how to charge the photosensitive member. In the above-described roller charging or furbrush charging, the untransferred toner is scattered into non-pattern distribution on the photosensitive member, and a higher bias voltage is applied to effect charging with the use of electric discharge in many cases. In the magnetic brush charging, powder is used as the contact charging member, and therefore, the magnetic brush portion of the electroconductive magnetic particle(powder) is softly contacted to the photosensitive member to charge the photosensitive member, but the equipment structure is complicated, and the problem attributable to the drop of the electroconductive magnetic particle constituting the magnetic brush portion is significant.

E) Coating of contact type charging member with electrically conductive powder

Japanese Patent Application Publication No. 7994/1995 discloses a contact type charging apparatus with such a structure that coats a contact type charging member with electrically conductive powder, on the surface which comes in contact with the surface of a member to be charged, so that surface of the member to be charged is uniformly charged, that is, without irregularity in charge. The contact type charging member in this charging apparatus is rotated by the rotation of the member to be charged, and the amount of ozone generated by this charging apparatus is remarkably small compared to the amount of ozonic products generated by a corona type charging apparatus such as scorotron. However, even in the case of this charging apparatus, the principle, based on which a member is charged, is the same as the principle, based on which a member is charged by the aforementioned charge roller; in other words, a member is charged by electrical discharge. Further, also in the case of this charging apparatus, in order to assure that member to be charged is uniformly charged, compound voltage composed of DC component and AC component is applied to the contact type charging member, and therefore, the amount of ozonic products traceable to electrical discharge becomes relatively large. Thus, even this contact type charging apparatus is liable to cause problems; for example, images are affected by ozonic products, appearing as if flowing, when this charging apparatus is used for an extended period of time, in particular, when this charging apparatus is used in a cleanerless image recording apparatus for an extended period of time.

Japanese Laid-open patent Application No. HEI-5-150539 discloses an image forming method using a contact charging wherein in order to avoid the charging problem due to deposition of the fine silica particles or tone particles during repeated long term image formation on the surface of the charging means, the developer contains at least visualizing particles and electroconductive particles having an average particle size smaller than that of the visualizing particles. However, the contact charging is based on the discharge-charging mechanism rather than the direct injection charging mechanism, and therefore, involves the above-described problems attributable to the discharging.

1) As described in the preceding paragraphs regarding the technologies prior to the present invention, it is difficult to effect the direct charging with the use of a contact type charging apparatus with a simple structure which comprises a contact type charging member such as a charge roller or a fur brush, since sufficiently close contact between the charging member and the member to be charged is not assured because of the roughness of the surface of the contact charging member, and therefore, it is not put into practice.

The contact charging member tends to pick foreign matter up from the surface of the member to be charged, and therefore, is easily contaminated; if the deposited contamination is insulative, the improper charging would result.

In view of this, in the contact charging, even if a simple member such as a charging roller, furbrush or the like is used as the contact charging member, a simple structure for ozoneless direct charging with low applied voltage is desired in which stabilized direct charging is accomplished with high uniform charging property for long term despite the contamination of the contact charging member.

When a contact charging device is employed in an image recording device to charge the image bearing member, it is very advantageous in the structure simplification and the performance if the ozoneless injection charging is accomplished with low voltage application, using a simple charging roller or furbrush as the contact charging member.

As regards the contamination of the contact charging member used in a transfer type image recording device employing it as the contact charging device for the charging means, it is difficult to completely remove the untransferred toner from the image bearing member by a cleaner which is provided exclusively for removing the untransferred toner from the image bearing member after the developer image (toner image) formed and carried on the image bearing member and then transferred onto a recording material. A small amount of the toner passing the cleaner is carried to the charge portion where the contact charging member and the image bearing member are contacted to each other, by the movement of the image bearing surface, and is deposited and accumulated on the contact charging member, so that contact charging member is gradually contaminated with the toner.

Since the conventional toner is insulative, existence of the toner in the charge portion which is a contact portion between the image bearing member and the contact charging member or the contamination of the contact charging member with the toner, are charge blocking factors which would result in the improper charging.

Particularly in an image recording device of toner recycling system (cleanerless), no addicted cleaner is employed to remove the untransferred toner from the image bearing surface after the image transfer, and therefore, the untransferred toner on the image bearing surface remaining after the image transfer, is carried to the charge portion which is a contact portion between the contact charging member and the image bearing member by the movement of the image bearing surface, with the result that contact charging member is remarkably contaminated with toner.

SUMMARY OF THE INVENTION

Accordingly, it is a principal object of the present invention to provide a charging device and an image forming apparatus wherein the applied voltage to the charging member is decreased to accomplish ozoneless charging.

It is another object of the present invention to provide a charging device and an image forming apparatus wherein injection charging from the charging member to the member to be charged is effected at low cost.

It is a further object of the present invention to provide a charging device and an image forming apparatus wherein satisfactory charging operation is possible even if the foreign matter such as toner is deposited to the charging member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Embodiment 1

Figure 1:
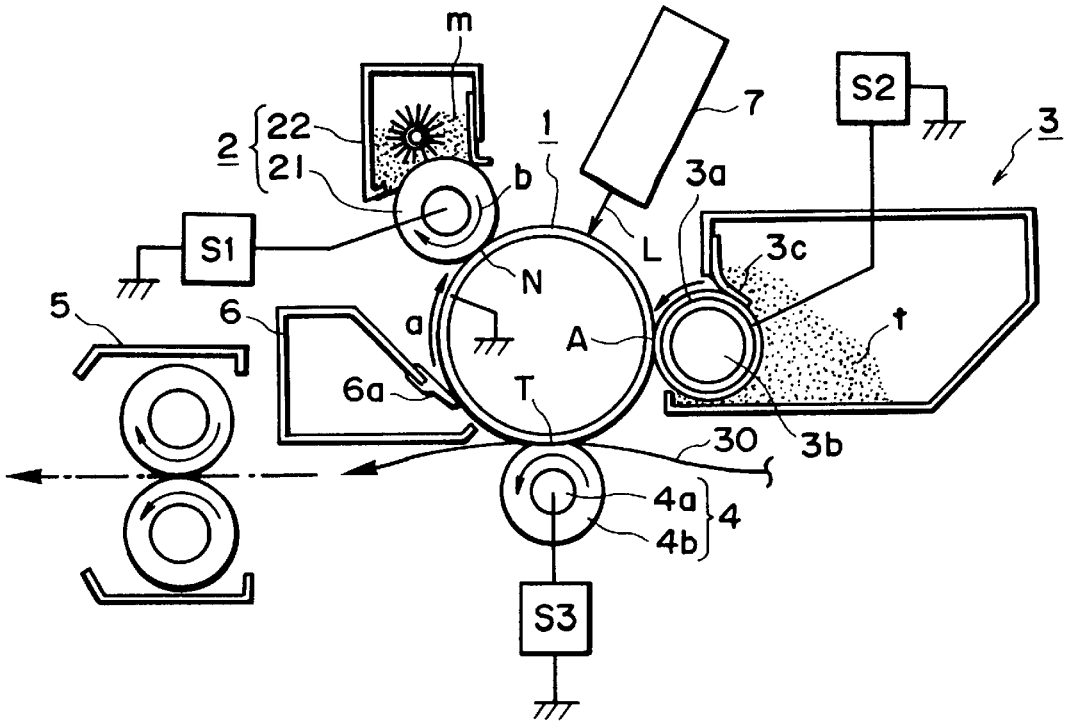
FIG. 1 is a schematic view of an image recording device according to Embodiment 1 of the present invention.
Figure 2:
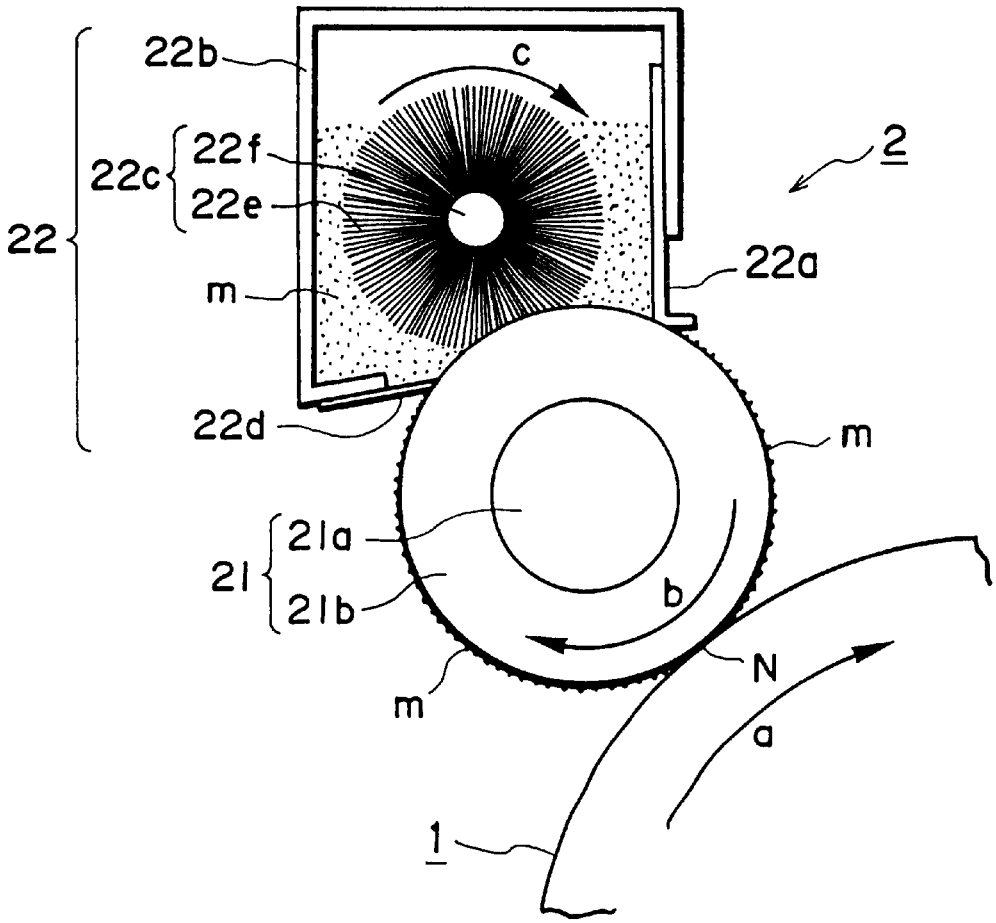
FIG. 2 is an enlarged schematic cross-sectional view of a contact charging device portion.

FIG. 1 is a schematic view of an example of an image recording device according to an embodiment of the present invention. FIG. 2 is an enlarged schematic cross-sectional view of a contact charging device portion.

The image recording device of this embodiment is in the form of a laser beam printer of a contact charging type using a transfer type electrophotographic process.

(1) General Arrangement of Printer

Designated by 1 is an image bearing member which is a negative OpC photosensitive member of rotatable drum type having a diameter of ϕ30 mm in this embodiment. The photosensitive drum 1 is rotated at a constant speed more particularly at a peripheral speed of 50 mm/sec (=process speed PS or printing speed) in the clockwise direction arrow.

Designated by 2 is a contact charging device for uniformly charging the outer surface of the photosensitive drum 1 to the predetermined polarity and potential, and it comprises a charging member 21 contacted to the photosensitive drum 1 and charging-promotion particle supply device 22 for supplying charging-promotion particles m to the charging member.

In this example, the charging member 21 is an electroconductive elastic roller (charging roller) as a contact charging member contacted to the photosensitive drum 1 with a predetermined urging force.

Designated by N is a charging nip (charge portion) formed between the photosensitive drum 1 and the charging roller 21. The charging roller 2 is rotated in a direction opposite from the peripheral movement direction of the photosensitive drum 1 in the charging nip N so that it is contacted to the surface of the photosensitive drum 1 with a speed difference.

To the outer surface of the rotating charging roller 21, the charging-promotion particles m are supplied from a charging-promotion particle supply device 22, and the charging-promotion particle m is present in the charging nip N between the photosensitive drum 1 and the charging roller 21.

The charging roller 21 is supplied with a predetermined charging bias (a DC voltage of −700 v in this example) from the charging bias applying voltage source S1.

By doing so, the peripheral surface of the rotatable photosensitive drum 1 is uniformly charged to substantially the same potential as the level of the application charging bias to the charging roller 21 through a direct charging (injection charging) system.

The charging roller 21, the charging-promotion particle supply device 22 and the direct charging phenomenon or the like of the contact charging device 2 will be described in detail hereinafter (2).

Designated by 4 is a laser beam scanner (exposure device) including a laser diode and a polygonal mirror. The laser beam scanner 7 emits a laser beam subjected to intensity modulation corresponding to time series electrical digital image signals of an intended image information, and the laser beam is projected onto the uniformly charged surface of the rotatable photosensitive drum 1 (scanning exposure L).

By the scanning exposure L, an electrostatic latent image is formed correspondingly to the intended image information on the surface of the rotatable photosensitive drum 1.

Designated by 3 is a developing device (developing device). The electrostatic latent image on the surface of the rotatable photosensitive drum 1 is developed into a toner image at the developing portion A by the developing device 3.

In this embodiment, the developing device 3 is a reverse development device using a one component magnetic toner (negative charged toner) as a developer t. Designated by 3*a* is a non-magnetic rotatable developing sleeve as a developer carrying member containing therein a magnet roller 3*b*, and the toner t as the developer in the developing device 3 is subjected to layer thickness regulation action of a regulation blade 3*c* and electric charge application during the toner being carried on the rotatable developing sleeve 3*a*.

The developer on the rotatable developing sleeve 3*a* is carried to a developing zone a where the sleeve 3*a* is opposed to the photosensitive member 1, by rotation of the sleeve 3*a*. The sleeve 3*a* is supplied with a developing bias voltage from a developing bias applying voltage source S2.

In the embodiment, the developing bias voltage contains the following components which are superimposed:

DC voltage: −500 V

AC voltage: peak-to-peak voltage of 1600 V, frequency of 1.8 kHz (rectangular wave)

The electrostatic latent image on the photosensitive drum 1 is reverse-developed with the toner t by this.

The one component magnetic toner t which is a developer produced by mixing binder resin, magnetic particles, coloring material and charge control material and kneading, pulverization and classifying them into toner powder. Fluidizing material or the like is added to the powder. The weight average particle size (D4) of the toner was 7 μm.

Designated by 4 is a transfer roller having an intermediate resistance and functioning as a contact type transferring means, and it is press-contacted to the photosensitive drum 1 at a predetermined pressure to form a transfer nip T. A transfer material 30 as a recording material is fed to the transfer nip T at a predetermined timing from an unshown sheet feeder, and a predetermined transfer bias voltage is applied to the transfer roller 4 from the transfer bias application voltage source S3 so that toner image is sequentially transferred from the photosensitive drum 1 onto the surface of the transfer material 30 fed to the sheet feeding.

The transfer roller 4 used in this embodiment comprises a core metal and an intermediate resistance foam layer thereon and has a roller resistance value of $5\times10^{8}\Omega$. The core metal was supplied with a voltage of +2.0 kV to effect the image transfer.

The transfer material 30 introduced to the transfer nip T is nipped and fed by the transfer nip b, during which the toner image is transferred from the rotatable photosensitive drum 1 onto the front side thereof by the electrostatic force and the pressure.

Designated by 5 is a fixing device of a heat fixing type or the like. The transfer material 30 now having the thus transferred toner image is separated from the surface of the rotatable photosensitive drum 1 and is fed to the fixing device 5, where the toner image is fixed, and is discharged out as a print (print or copy).

Designated by 6 is a cleaner (cleaning device) for the photosensitive drum. The untransferred toner of the surface of the drum after toner image transfer to the transfer material T, is scraped off by the cleaning member 6*a* of the cleaner 8 (cleaning blade (elastic blade) contacted to the surface of the photosensitive drum 1 in this example) to be prepared for the repeated image formation.

The untransferred toner removed from the surface of the photosensitive drum 1 by the cleaning blade 6*a*, is accumulated in a cleaner container as residual toner.

(2) Contact Charging Device 2 a) charging roller 21

The charging roller 21 as a flexible contact charging member, is produced by forming, on a core metal 21*a*, an intermediate resistance layer 21*b* (flexible member) of rubber or foam material.

The intermediate resistance layer 21*b* comprises resin material (e.g. Urethane), electroconductive particles (e.g. Carbon black), sulfurizing material, foaming material or the like and is on the core metal 21*a* into the form of roller. Thereafter, the surface was abraded, upon necessity, to produce a charging roller 21 in the form of an electroconductive elastic roller having a length 200 mm and a diameter of 12 mm.

The roller resistance of the charging roller 21 in this embodiment was 100 kΩ. The roller resistance was measured as follows. The charging roller 21 was press-contacted to the aluminum drum having a diameter of 30 mm such that total pressure 1 kg was applied to the core metal 21*a* of the charging roller 21, and 100 v was applied between the core metal 21*a* and the aluminum drum.

It is important that charging roller 21 which is a contact charging member functions an electrode. Namely, it is given the elasticity to provide sufficient contact state to the member to be charged, and simultaneously, it has a sufficiently low resistance to charge the moving member to be charged. On the other hand, in view of the case that member to be charged has a low withstand level portion such as a pin hole, the leakage has to be prevented. When the use is made with the photosensitive member for electrophotography as the member to be charged, the resistance of $10^4$–$10^7$ Ω is desirable from the standpoint of providing sufficient charging property and anti-leakage.

The surface of the charging roller 21 is desirably provided with micromatic unsmoothness to hold the charging-promotion particles m.

If the hardness of the charging roller 21 is too low, the configuration is not stabilized with the result that contact property with the member to be charged is poor, and if it is too high, no sufficient charging nip N is assured between the member to be charged and itself, and also, the microscopic contact property to the surface of the member to be charged is poor, and therefore, the hardness is preferably 25° to 50° in Asker C hardness.

The material of the charging roller 21 is not limited to the elastic foam, but other examples of the elastic member include rubber material or rubber foam such as EPDM, urethane, NBR, silicon rubber, IR or the like in which electroconductive substance such as carbon black, metal oxide or the like is dispersed for resistance adjustment. It is possible to adjust the resistance using the ion electroconductive material without dispersing the electroconductive substance.

The charging roller 21 is press-contacted to the photosensitive drum 1 as the member to be charged with a predetermined pressure against the elasticity to form a charging nip N having a width of several mm in this embodiment.

In this embodiment, the charging roller 21 is rotated in the clockwise direction indicated by the arrow at approx. 80 rpm so that charging roller surface and the photosensitive member surface move in the charging nip N at the same speed in the opposite directions. Thus, there is a speed difference between the surface of the charging roller 21 as the contact charging member and the surface of the photosensitive drum 1.

The core metal 21*a* of the charging roller 21 is supplied with a DC voltage of −700 V as the charging bias from the voltage source S1.

b) charging-promotion particle supply device 22

The charging-promotion particle supply device 22 is disposed above the charging roller 21, and functions to supply the charging-promotion particles m to the outer surface of the rotating charging roller 21. In this embodiment, a furbrush (fiber brush) and a roller 22*c* (FIG. 2) are contacted to the charging roller 21 to supply the charging-promotion particles m. The furbrush roller 22*c* refreshes the surface of the charging roller 21, and can hold the charging-promotion particles m among the fibers, and the particles can be easily transferred onto the outer surface of the charging roller 21, and therefore, the charging-promotion particle can be stably applied.

When for example the particles m are supplied to the charging roller 21 by a blade contacted to the roller 21, the circulation of the toner is stagnated when the toner is introduced, and therefore, the particles m are not properly supplied.

The charging-promotion particle supply device 22 in this embodiment comprises a housing container 22*b*, a furbrush roller 22*c*, a regulating member 22*a*, a sealing sheet 22*d* and the charging-promotion particle m s.

The housing container 22*b* is an elongated container having a length which is substantially the same length as the charging roller 21, and has an opening at the bottom. It accommodates the furbrush roller 22*c* and the charging-promotion particles m therein.

The furbrush roller 22*c* is contacted to the charging roller 21 at the bottom opening of the housing container 22*b* substantially over the entire length of the roller to slide the outer surface of the charging roller, and functions to refresh the charging roller 21 and apply the charging-promotion particles, and it is rotatably mounted in the housing container 22*b* to the bearings of the opposite end plates of the housing container 22*b*. It is an elongated member having a length which is substantially the same as the charging roller 21.

The furbrush roller 22*c* has a core metal 22*f* and a furbrush 22*e* including fibers planted in the form of piles to a base textile. The fiber density is 500 on the base textile, and the fiber length (length of free portion) is 3 mm in this embodiment. The distance between the core metal 21*a* of the charging roller 21 and the core metal 22*f* of the furbrush roller 22*c* such that surface layer of the charging roller 21 is at a position of 2 mm from the surface layer of the core metal 22*f*, by which the furbrush roller 22*c* is contacted to the charging roller 21.

The regulating member 22*a* functions to regulate the charging-promotion particles supplied to the charging roller 21 excessively, and is in the form of an elongated blade member having a length which is substantially the same as the charging roller 21, and is securedly mounted to the inside of the downstream (relative to the rotational direction of the charging roller 21) side wall plate of the housing container 22*b* to extend in the longitudinal direction. The bottom side thereof is lightly contacted to or very closely disposed to the outer surface of the charging roller 21.

The sealing sheet 22*d* is of an elongated piece of a plastic resin material sheet having a relatively high rigidity, and functions to prevent leakage of the charging-promotion particles through a gap between the charging roller 21 and the bottom portion of the upstream side wall plate of the housing container 22*b* with respect to the rotational direction of the charging roller 21. An inward bent portion is formed at the edge portion of the bottom portion of the upstream side wall plate of the housing container 22*b*, along the length thereof, and to the bottom surface of the inward bent edge portion, the base portion of the sealing sheet 22*d* is bonded and fixed along the longitudinal direction of the edge portion. The free end side thereof is very closely disposed to or lightly contacted to the outer surface of the charging roller 21. By the sealing sheet 22*d*, the gap between the charging roller 21 and the bottom portion of the upstream side wall plate of the housing container 22*b* is substantially closed, so that charging-promotion particles are blocked from leaking.

The charging-promotion particles m accumulated in the housing container 22*b*, are accommodated in a substantially sealed space enclosed by the housing container 22*b*, the regulating member 22*a*, the sealing sheet 22*d* and the upper surface portion of the charging roller 21, and therefore, they do not leak or scatter to the outside of the housing container 22*b*. Many charging-promotion particles m are retained in the furbrush 22*e* of the furbrush roller 22*c* disposed in the housing container 22*b*.

In this embodiment, the charging-promotion particle m is of electroconductive zinc oxide particle having a resistivity of $10^6$ Ωcm and an average particle size of 3 μm.

The material of the charge promotion particles m may be electroconductive inorganic particles of metal oxide or a mixture thereof with organic material, which may be subjected to the surface treatment.

The specific resistance of the particles 3 is desired to be no more than $10^{12}$ Ohm.cm, preferably, no more than $10^{10}$ Ohm.cm, since electrical charge is given or received therethrough. The specific resistance of the charging-promotion particles 3 is obtained using a tablet method. That is, first, a cylinder which measures 2.26 $cm^2$ in bottom area size is prepared. Then, 0.5 g of a material sample is placed in the cylinder, between the top and bottom electrodes, and the resistance of the material is measured by applying 100 V between the top and bottom electrodes while compacting the material between the top and bottom electrodes with a pressure of 15 kg. Thereafter, the specific resistivity of the sample material is calculated from the results of the measurement through normalization.

The particle size is desirably not more than 50 μm for the satisfactory uniform charging property.

The particle size of coagulated material of the particles is defined as an average particle size of the coagulated materials. As for the method of measuring the particle size, more than 100 particles are extracted using an optical or electron microscope, and the volume particle size distribution is calculated on the basis of a maximum arc distance in the horizontal direction, and the particle size is defined as the 50% average particle size.

The charging-promotion particles m may be in the form of primary particles or secondary particles. The state of coagulations is not material if they functions to promote the charging, but the particle density is of importance.

The charge promotion particles are white or almost transparent particles from the standpoint of avoiding disturbance to the latent image exposure when it is used for charging the photosensitive member.

Since a part of the charge promotion particles are unavoidably transferred onto the transfer material 30 from the photosensitive member, it is desirably white or non-color in the case of color recording. From the standpoint of preventing the light scattering by the particles during the image exposure, the particle size is desirably not more than the constituent pixel size. The lower limit of the particle size is 10 nm from the standpoint of stabilized production thereof.

In this embodiment, the furbrush roller 22*c* of the charging-promotion particle supply device 22 is rotated at a predetermined peripheral speed in the clockwise direction indicated by an arrow c through an unshown driving system during rotation of the charging roller 21.

The rotating charging roller 21 is rubbed by rotating furbrush roller 22 so that outer surface thereof is sufficiently refreshed, and the charging-promotion particles m are applied thereon. The regulating member 22*a* disposed downstream of the furbrush roller 22*c* with respect to the rotational direction of the charging roller, regulates the amount of the charging-promotion particles m applied thereto to accomplish uniform supply of the charging-promotion particles m.

The proper amount of the charging-promotion particles m applied on the outer surface of the charging roller 21 from the charging-promotion particle supply device 22 with the regulation, is carried to the charging nip N formed between the charging roller 21 and the photosensitive drum 1 by the continuing rotation of the charging roller 21, and is always supplied with stability, so that sufficient amount of the charging-promotion particles m exists at all times at each part of the charging nip N with stability.

(3) Direct Charging

By the existence of the charging-promotion particles m in the charging nip N, charging nip N, a charging roller which has a large friction resistance and which therefore is not easily contacted to the photosensitive drum 1 with speed difference, can be easily contacted thereto with the speed difference, because of the lubricant effect of the particles m, and simultaneously, the charging roller 21 is electrically close-contacted to the surface of the photosensitive drum 1 by the provision of the particles m, so that it is virtually contacted thereto at high frequency.

Figure 9:
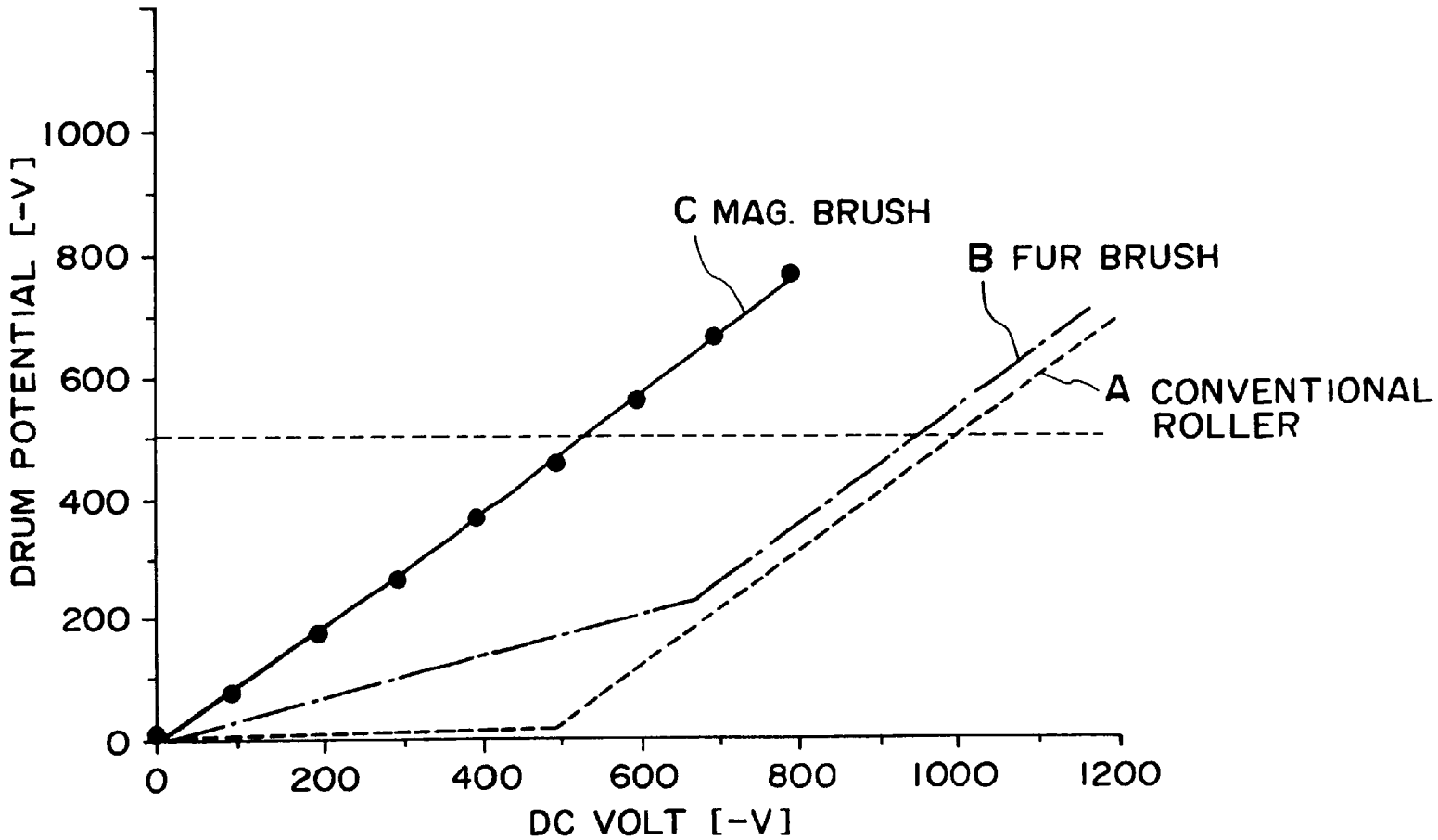
FIG. 9 is a graph of a charging property.

By the provision of the speed difference between the photosensitive drum 1 and the charging roller 21, the chances of contacts between the charging-promotion particles m and the photosensitive drum 1 in the nip between the photosensitive drum 1 and the charging roller 21 are increased remarkably, so that contact between the photosensitive drum and the charging roller is improved. The charging-promotion particles m present in the nip between the photosensitive drum 1 and the charging roller 21 rub the surface of the photosensitive drum 1 without non-contact portion, so that charge is directly injected into the photosensitive drum 1, and in such a contact charging of the photosensitive drum 1 by the charging roller 21, the direct charging (injection charging) is dominant by the presence of the charging-promotion particles. Thus, the charging property shown in FIG. 9, C is provided.

The image recording device (printer) of this embodiment is provided with a cleaner 6 for removing the untransferred toner from the surface of the photosensitive drum 1 after the transfer, this is provided since it is not possible to completely remove the untransferred toner from the surface of the photosensitive drum 1. In the image recording device (or printer) of this embodiment, the cleaner 6 is used to remove the untransferred toner from the surface of the photosensitive drum 1 after the image transfer, but it is difficult to completely remove the untransferred toner from the surface of the photosensitive drum 1, and particularly in the case of the cleaning using the elastic blade employed in the embodiment, fine particles having a small size pass under the blade 6 a, and the blade is not turned over. Therefore, even in the image recording device provided with the cleaner 6, a small amount of the toner (insulative substance) particles which are a charge blocking factor is carried into the charging nip N, and is present in the nip or contaminates the charging roller 21. Even in such a case, the existence of the sufficient amount of the charging-promotion particles m in the charging nip N between the charging roller 21 and the photosensitive drum 1, is effective to prevent the contamination of the charging roller 21, and therefore, the contact property decrease due to the toner is compensated for, thus maintaining the close-contactness and the contact resistance between the charging roller 21 and the photosensitive drum 1, so that ozoneless direct charging with low applied voltage can be stably maintained with uniform charging property.

With the use of the apparatus, the charge promotion particles m may drop from the charging nip n between the charging roller 21 and the photosensitive drum 1. However, by the provision of the charging-promotion particle supply device 22 for supplying the charging-promotion particles m to the charging roller 21, the charging-promotion particles m are supplemented, so that reduction of the charging property due to the drop-out or decrease of the charging-promotion particles m from the charging nip n, is prevented, thus maintaining the stabilized direct charging property for long term.

Thus, a high charging efficiency is provided which is not provided in the conventional roller charging or the like of contact charging type, and the photosensitive drum 1 can be charged to the potential substantially equal to the voltage applied to the charging roller 21. Even when the use is made with a simple and easy charging roller 21 as the contact charging member, the applied bias required by the charging roller 21 for the charging is not increased significantly by the contamination of the charging roller 21. Thus, there is provided a stable and safe direct contact charging device which does not use the discharge phenomenon (ozoneless) and which is operable with low applied voltage to provide high uniform charging for long term.

When it is used with an image recording device or an image recording device of the transfer type, the simple and easy charging roller 21 is usable which can effect the ozone-less direct charging with low applied voltage despite the toner contamination, and a high quality image formation can be maintained for a long term, and the high quality image formation is maintained for a long term even after images of height image ratio are processed.

If the amount of the charge promotion particles existing in the charging nip n between the charging roller 21 as the contact charging member and the photosensitive drum 1 as the image bearing member is too small, the lubricating effect is not sufficient with the result that friction between the photosensitive drum 1 and the charging roller 21 is too large, and therefore, it is difficult to rotate the charging roller 21 with speed difference relative to the photosensitive drum 1. In other words, the driving torque is too large, and if they are forced to rotate, the surface of the charging roller 21 and/or the photosensitive drum 1 may be scraped. Furthermore, the effect of contact chance increase by the particles, may not be provided with the result that charging property is not sufficient. On the other hand, if the amount is too large, the drop-out of the charge promotion particles from the charging roller 21 is remarkably increased with the result of adverse influence to the image formation. The experiments have revealed that amount is desirably $10^3/mm^2$ or more. If it is smaller than $10^3/mm^2$, the lubricating effect and the contact chance increase effect are not sufficient with the result of the decrease of the charging property.

Further preferably, the amount is $10^3$–$5\times10^5/mm^2$. If it exceeds $5\times10^5/mm^2$, the drop-out of the particles onto the photosensitive member 1 is remarkable, and the exposure amount shortage of the photosensitive drum 1 results irrespective of the light transmissivity of the particle per se. If it is $5\times10^5/m^2$ or smaller, the amount of the particles which drop out can be suppressed, thus avoiding the adverse influence. The amount of the dropped out particles on the photosensitive drum 1 was $10^2$–$10^5/mm^2$ within the above-described range of amount, and therefore, the desirable amount is $10^5$/mm2 or less.

The method used for measuring the amount of the charging-promotion particles 3 between the charge roller 2 and the photosensitive drum 1, and the amount of the charging-promotion particles 3 on the photosensitive member 1, will be described. It is desirable that amount of the charging-promotion particles 3 between the charge roller 21 and the photosensitive member 1 is directly measured in the charging nip n between the charge roller 2 and the photosensitive member 1. However, most of the particles on the photosensitive drum 1 before the contact to the charging roller 21 are removed to the charging roller 21 while moving in the opposite direction, and therefore, the amount of the charge promotion particles on the charge roller 21 measured immediately before the charging nip n is substituted for the actual amount of the charging-promotion particles between the charge roller 2 and the photosensitive member 1. More specifically, the rotation of the photosensitive drum 1 and charge roller 2 is stopped, and the peripheral surfaces of the photosensitive drum 1 and the charge roller 21 are photographed by a video-microscope (product of Olympus: OVM1000N) and a digital still recorder (product of Deltis: SR-3100), without applying the charge bias. In photographing the peripheral surface of the charge roller 21, the charge roller 21 is pressed against a piece of slide glass under the same condition as the charge roller 21 is pressed against the photosensitive member 1, and no less than 10 spots in the contact are between the charge roller 21 and the slide glass were photographed with the use of the video-microscope fitted with an object lens with a magnification power of 1,000. The thus obtained digital images are digitally processed using a predetermined threshold. Then, the number of cells in which a particles is present is counted with the use of a designated image processing software. As for the amount of the charging-promotion or promotion particles on the photosensitive member 1, the peripheral surface of the photosensitive drum 1 is photographed using the same video-microscope, and then, the obtained images are processed in the same manner to obtain the number of the charging-promotion particles on the photosensitive member 1.

The amount of the particles is adjusted by setting the degree of application of the charge promotion particles to the charging roller 2 by the charging-promotion particle supply device 22.

Embodiment 2

(FIG. 3)

The printer of this embodiment is similar to that of above-described Embodiment 1, but is not provided with the cleaner 6 (toner recycling system, or cleanerless system).

The structure of the printer of this embodiment is the same as that of the printer of Embodiment 1 in the other respects, and therefore, the detailed description thereof is omitted.

In the cleanerless image recording device, there is no cleaner exclusively for removing the untransferred toner from the photosensitive drum surface after the image transfer, and therefore, untransferred toner is carried to the charging nip N between the charging roller 21 and the photosensitive drum 1 by the movement of the photosensitive drum surface, and therefore, the toner amount in the charging nip n is larger than in the printer provided with the cleaner 6 of Embodiment 1, and the toner amount deposited and mixed into the charging roller 21 is also larger than that.

Even in such a case, however, the ozoneless direct charging can be effected with low applied voltage for a long term with stability, by the existence of the charge promotion particles m in the charging nip N between the photosensitive drum 1 and the charging roller 21 which is effective to prevent contamination of the charging roller 21 with the toner and to compensate for the contact property decrease, thus maintaining the proper close contact and proper contact resistance between the charging roller 21 and the photosensitive drum 1.

By the speed difference between the photosensitive drum 1 and the charging roller 21, the pattern of the untransferred toner arriving at the charging nip N from the transfer nip portion T is disturbed, and therefore, the ghost image which is a previous pattern appearing in the next image can be avoided a halftone image.

The charging roller 21 is rotated to temporarily collect the untransferred toner and uniform it, and it is desirable to rotate it in a direction opposite from the movement direction of the photosensitive drum surface in the nip.

The untransferred toner is introduced to the charging roller 21 and the charging-promotion particle supply device 22 of the charging device 2 (toner recycling). However, in this embodiment, the charging-promotion particle supply device 22 comprises the furbrush roller 22*c* and the regulating member 22*a*, and therefore, the charging-promotion particles can be supplied to the charging roller 21 without scattering and with stability, and particularly, in the structure of the toner recycling system (cleanerless) type, the untransferred toner can be circulated without stagnation on the charging roller 21 so that charging-promotion particles m can be properly supplied. In other words, the supply of the charge promotion particle m to the charging roller 21 and the toner uniformalization on the charging roller are simultaneously effected.

The close-contactness with the photosensitive drum 1, and the proper contact resistance can be maintained so that direct charging is accomplished.

The mixed untransferred toner or the untransferred toner deposited on the charging roller 21, are gradually discharged to the photosensitive drum from the charging roller 21, and is carried to the developing portion a by the movement of the photosensitive drum surface, and it is removed (collected) simultaneously with the development by the developing device 3 (toner recycling).

The photosensitive member 1 having the toner remaining thereon after the transfer, is charged by the charging roller 21, exposed to image light by the laser scanner 7 so that latent image is formed. During the developing operation for the latent image, the toner is collected to the developing device by a fog removing potential difference Vback (the potential difference between the surface potential of the photosensitive member and a DC voltage applied to the developing device) for removing background fog. In the case of the reverse development as in the printer in this embodiment, the simultaneous development and cleaning is carried out by the electric field collecting the toner onto the developing sleeve from the dark potential portion of the photosensitive member and the electric field depositing the toner onto the light potential portion of the photosensitive member from the developing sleeve.

In this embodiment, the charge promotion particles m are of zinc oxide particles, and the zinc oxide particles as the charging-promotion particles m, tend to charge the toner to the negative polarity due to the triboelectric charge property as compared with that of the toner. In other words, it is effective to charge the toner uniformly on the charging roller 21, thus improving the toner discharge.

By repeating the foregoing process, the direct charging is accomplished with the toner recycling and is maintained for log term.

Embodiment 3

(FIG. 4)

Figure 4:
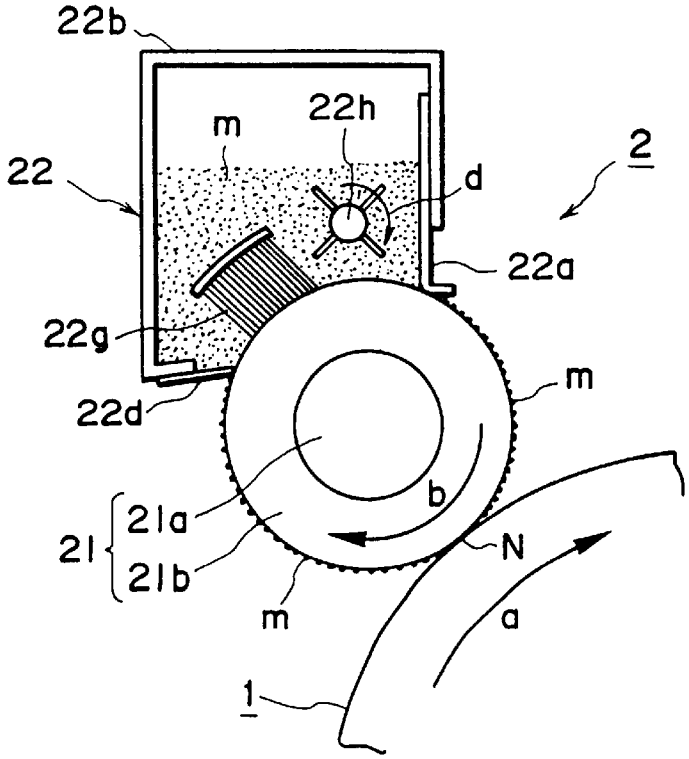
FIG. 4 is an enlarged schematic cross-sectional view of a contact charging device portion of the image recording device according to Embodiment 3.

The printer of this embodiment is similar to that of Embodiment 1 ((FIGS. 1, 2), but the charging-promotion particle supply device 22 of the charging device 2 for the charging roller 21 is modified as shown in FIG. 4.

More particularly, a fixed furbrush 22*g* (non-rotatable) is used in place of the rotatable furbrush roller 22*c*. A stirring member 22*h* for the charging-promotion particle m is added in the housing container 22*b*. The other structures are substantially the same as Embodiment 1, and therefore, the detailed description of the common parts is omitted.

The fixed furbrush 22*g* is an elongated member having a length which is substantially the same as the charging roller 21, and fibers are planted in a base textile and into a pile form fur brush. The furbrush is fixed on a supporting plate.

The fiber density is 500 on the base textile, and the fiber length (length of free portion) is 3 mm in this embodiment. The furbrush 22*g* is non-rotatably fixed in the housing container 22*b* in contact to the charging roller 21.

The stirring member 22*h* in this embodiment is disposed downstream of the fixed furbrush 22*g* in the housing container 22*b* with respect to the rotational direction of the charging roller, and comprises a core metal and a several fins mounted thereto. The stirring member 22*h* is disposed without contact to the charging roller 21 and is rotatably supported by bearings in end plates of the housing container 22*b*, and it has an elongated member having a length which is substantially the same as the charging roller 21.

In this embodiment, the stirring member 22*h* of the charging-promotion particle supply device 22, when the charging roller 21 is rotated, is rotated at a predetermined peripheral speed in the clockwise direction indicated by an arrow d through an unshown driving system.

The rotating charging roller 21 is rubbed with the non-rotating fixed furbrush 22*g* in the charging-promotion particle supply device 22 so that outer surface is refreshed, and then, the charging-promotion particles m are deposited thereto by the stirring member 22*h*. The regulating member 22*a* regulates the amount of the charging-promotion particles m applied thereto to accomplish uniform supply of the charging-promotion particles m.

The proper amount of the charging-promotion particles m applied on the outer surface of the charging roller 21 from the charging-promotion particle supply device 22 with the regulation, is carried to the charging nip N formed between the charging roller 21 and the photosensitive drum 1 by the continuing rotation of the charging roller 21, and is always supplied with stability, so that sufficient amount of the charging-promotion particles m exists at all times at each part of the charging nip n with stability.

The non-rotatable furbrush 22*g* does not scatter the charging-promotion particles m.

Embodiment 4

(FIG. 5)

Figure 5:
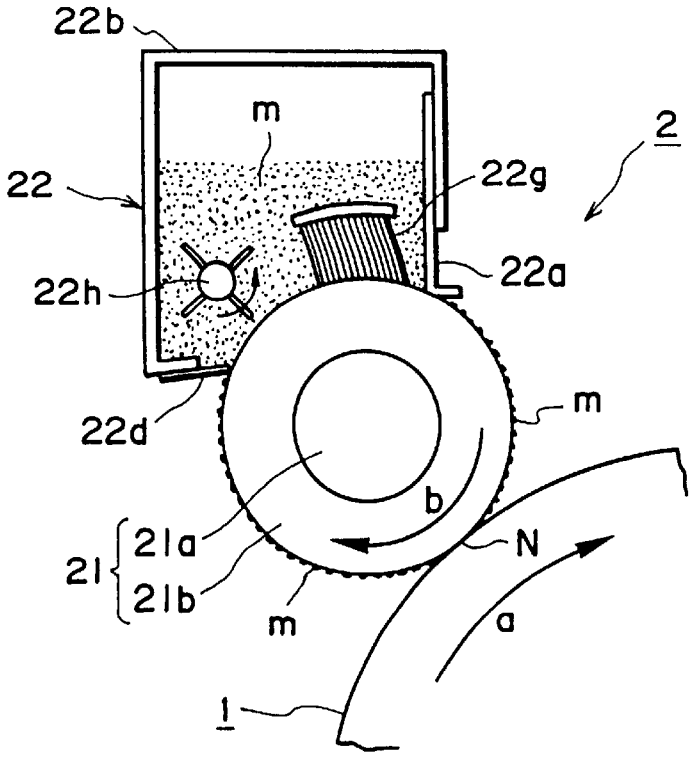
FIG. 5 is an enlarged schematic cross-sectional view of a contact charging device portion of the image recording device according to Embodiment 4.
Figure 6:
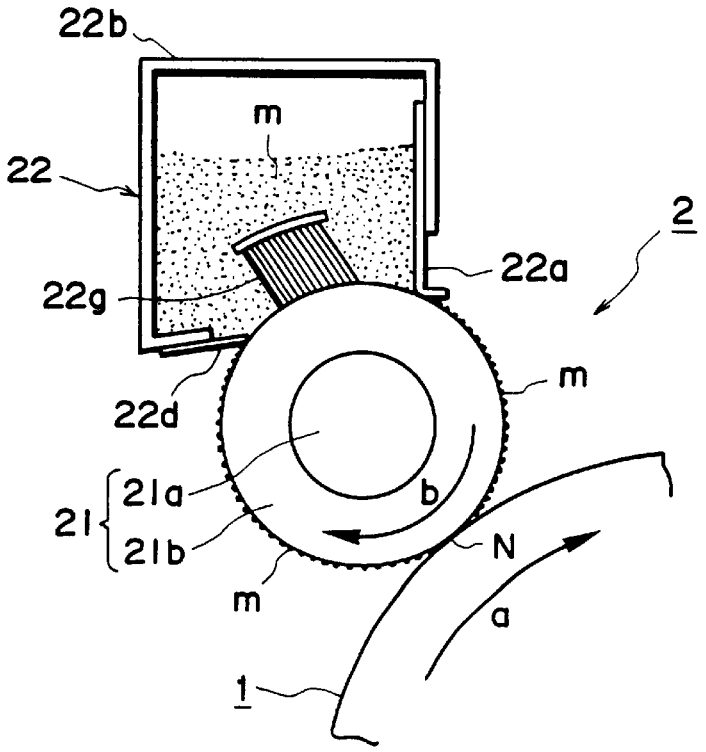
FIG. 6 is an enlarged schematic cross-sectional view of a contact charging device portion of the image recording device according to Embodiment 5.

This embodiment is similar to said Embodiment 3, but the positions of the fixed furbrush 22*g* in the housing container 22*b* and the stirring member 22*h* are exchanged as shown in FIG. 5. More particularly, in the housing container 22*b*, the stirring member 22*h* is disposed in the upstream side, and the fixed furbrush 22*g* is disposed in the downstream side with respect to the rotational direction of the charging roller.

In the embodiment, the rotating charging roller 21 first receives the charging-promotion particles m by the rotating stirring member 22*h* in the charging-promotion particle supply device 22, and then, it is rubbed with the fixed furbrush 22*g* so that outer surface is refreshed. The regulating member 22*a* regulates the amount of the charging-promotion particles m applied thereto to accomplish uniform supply of the charging-promotion particles m.

The proper amount of the charging-promotion particles m applied on the outer surface of the charging roller 21 from the charging-promotion particle supply device 22 with the regulation, is carried to the charging nip N formed between the charging roller 21 and the photosensitive drum 1 by the continuing rotation of the charging roller 21, and is always supplied with stability, so that sufficient amount of the charging-promotion particles m exists at all times at each part of the charging nip N with stability.

In this embodiment, the fixed furbrush 22*g* has a certain degree of charging-promotion particle amount regulation power, and therefore, and the regulating member 22*a* may be omitted by disposing it at the most downstream position in the charging-promotion particle supply device 22.

Embodiment 5

(FIG. 6)

This embodiment is similar to the above Embodiment 3, but the stirring member 22*h* is omitted, and the fixed furbrush 22*g* is swingable in the longitudinal direction of the charging roller 21. When the charging roller 21 is rotated, the furbrush 22*g* is swung in the longitudinal direction of the charging roller 21 by an unshown furbrush swinging means (for example, an electromagnetic solenoid mechanism, crank mechanism or the like).

In this embodiment, the rotating charging roller 21 is rubbed with the swinging furbrush 22*g* which swings in the longitudinal direction (axial direction) of the charging roller 21 in the charging-promotion particle supply device 22, so that outer surface is more positively refreshed, and therefore, that circulation supply of the charging-promotion particles m is enhanced. The regulating member 22*a* regulates the amount of the charging-promotion particles m applied thereto to accomplish uniform supply of the charging-promotion particles m.

The proper amount of the charging-promotion particles m applied on the outer surface of the charging roller 21 from the charging-promotion particle supply device 22 with the regulation, is carried to the charging nip N formed between the charging roller 21 and the photosensitive drum 1 by the continuing rotation of the charging roller 21, and is always supplied with stability, so that sufficient amount of the charging-promotion particles m exists at all times at each part of the charging nip N with stability.

In this embodiment the swinging furbrush 22*g* has a certain degree of charging-promotion particle amount regulation power, and therefore, and the regulating member 22*a* may be omitted by disposing it at the most downstream position in the charging-promotion particle supply device 22.

Comparison Example 3

Figure 7:
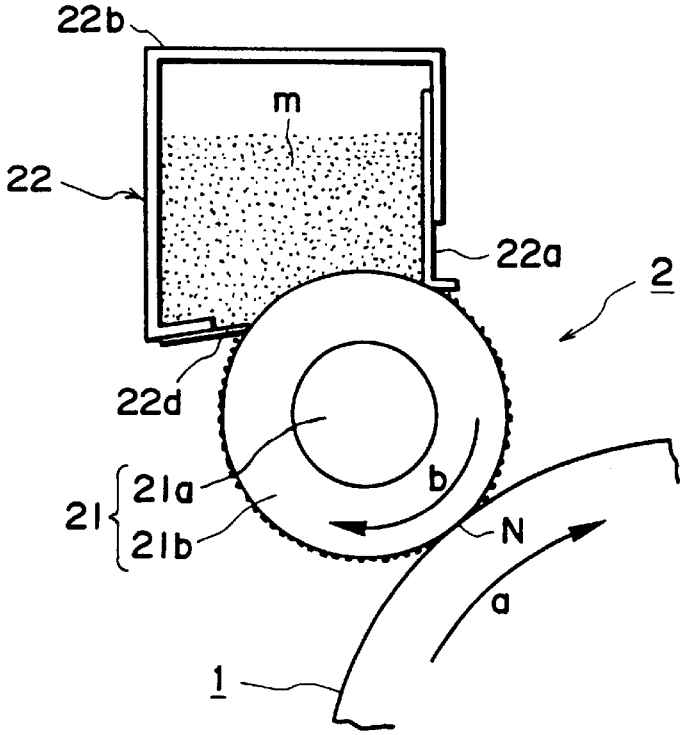
FIG. 7 is an enlarged schematic cross-sectional view of a contact charging device portion of an image recording device according to comparison examples 1 and 2.

(FIGS. 1 and 7)

This example corresponds to Embodiment 1 (FIGS. 1, 2), but the furbrush roller 22*c* is not provided in the charging-promotion particle supply device 22 for the charging roller 21 of the charging device 2. Thus, the charging-promotion particle supply device 22 is constituted by the housing container 22*b*, the regulating member 22*a*, the sealing sheet 22*d* and the charging-promotion particles m accommodated in the housing container 22*b*.

The other structures are the same as the printer of Embodiment 1.

With the charging-promotion particle supply device 22 as shown in FIG. 7, the charging-promotion particles m are supplied to the charging roller 21 which is rotating, the stability of the supply may involve a problem in view of the supply power of the charging-promotion particles m since there is neither the positive charging-promotion particle application and supply functions by the furbrush nor the refreshing function for the outer surface of the charging roller.

Comparison Example 2

(FIGS. 3, 7)

Figure 3:
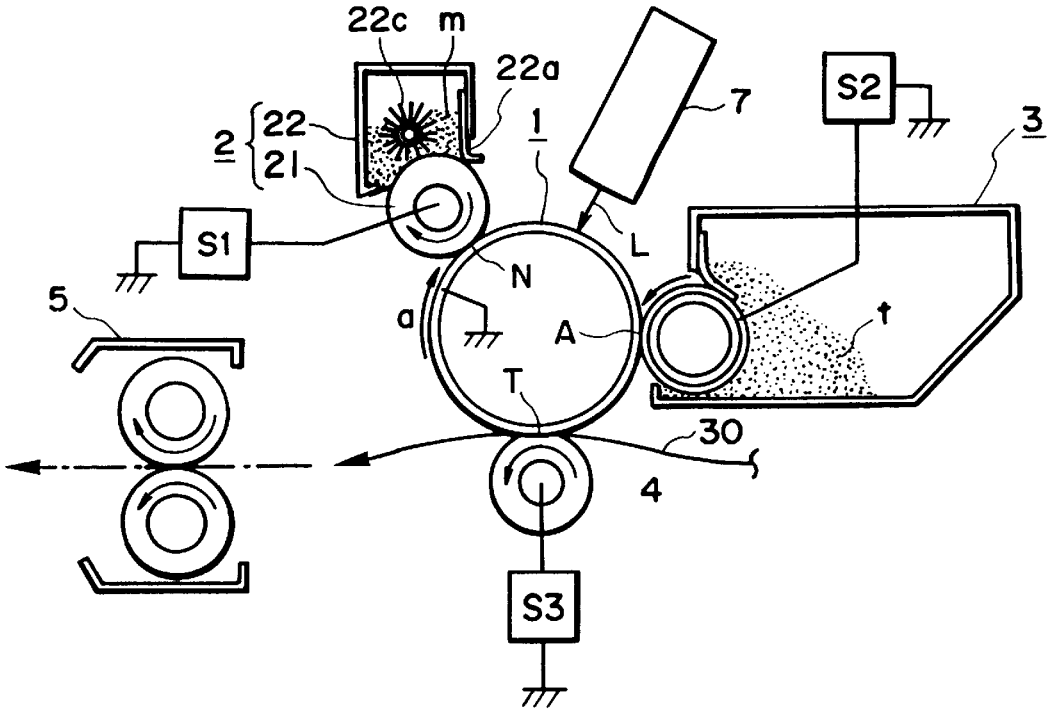
FIG. 3 is a schematic view of an image recording device (cleanerless) according to Embodiment 2 of the present invention.

This corresponds to the cleanerless printer of Embodiment 2 (FIG. 3), but the furbrush roller 22*c* for the charging roller 21 of the charging device 2 in the charging-promotion particle supply device 22 is omitted as shown in FIG. 7. Thus, the charging-promotion particle supply device 22 is constituted by the housing container 22*b*, the regulating member 22*a*, the sealing sheet 22*d* and the charging-promotion particles m accommodated in the housing container 22*b*.

The other structures are the same as the cleanerless printer of Embodiment 2.

As described in connection with comparison example 1, with the charging-promotion particle supply device 22 as shown in FIG. 7, the charging-promotion particles m are supplied to the charging roller 21 which is rotating, the stability of the supply may involve a problem in view of the supply power of the charging-promotion particles m since there is neither the positive charging-promotion particle application and supply functions by the furbrush nor the refreshing function for the outer surface of the charging roller.

Evaluation

The evaluations are made with respect to said Embodiments 1–5 and comparison examples 1 and 2. The results are given in Table 1.

TABLE 1

| | Toner recycle | initial charging property <10 shts | durability of charging property =300 shts |
|---|---|---|---|
| Embodiment 1 With fur roller and cleaner | no | E | E |
| Embodiment 2 Without fur roller and cleaner | yes | E | F |
| Embodiment 3 With fur roller, stirring means and cleaner | no | E | E |
| Embodiment 4 With stirring means, fur and cleaner | no | G | G |

TABLE 1-continued

| | Toner recycle | initial charging property <10 shts | durability of charging property =300 shts |
|---|---|---|---|
| Embodiment 5 With fur, swinging and cleaner | no | G | G |
| Comp ex 1 With cleaner | no | G | NG |
| Comp ex 2 Without cleaner | yes | G | NG |

a) charging property

The charging property was evaluated on the basis of deterioration of the ghost image.

In the printers of the foregoing embodiments, the image is developed through reverse development, and therefore, the ghost image here means the image of the previous image pattern where the light is projected (toner portion) and where the charging in the next image formation is not sufficient. The image evaluation was based on the following. After one solid black image is formed, an image is formed and is evaluated.

NG: a ghost pattern is seen in the white background portion after the solid black image formation.

G: No ghost pattern is seen in the white background portion, but a ghost pattern is slightly seen in the half-tone portion, after the solid black image formation.

F: the same as with "G", but the lowering of potential due to toner introduction occurs. E: No ghost pattern is seen in the white background portion or the half-tone portion after the solid black image formation.

The evaluation is made at the initial stage of the printing and at 300 sheets printing (A4 sheets were fed in the longitudinal direction).

The print ratio of the test image pattern was 5% and was constant in the longitudinal direction.

Advantages of Embodiments 1–5

(1) in the printer of comparison example 1, the charging-promotion particles m are supplied to the charging roller 21, but the circulation of the charging-promotion particles is not good, with the result that proper amount of the charging-promotion particles are not assured, and therefore, the ghost image is produced in the half-tone portion. Additionally, with the operation, the vicious circle arises including the introduction of the toner and the improper charging, with the result that charging property is increasingly deteriorated. It was not possible to maintain the charging property of the charging roller 21 even by using the cleaner 6.

(2) in the printer of comparison example 2, the toner introduction to the charging roller 21 is large because of non-use of the cleaner, and the charging property is further deteriorated. The pattern of the residual toner on the photosensitive drum 1 is removed by the charging roller 21, but improper charging in the form of the pattern remains.

(3) in the printer of Embodiment 1, the application and supply of the charging-promotion particles m are carried out by the charging-promotion particle supply device 22 to the charging roller 21, so that satisfactory charging property is provided.

(4) in the printer of Embodiment 2 (cleanerless), the toner is introduced to the charging device with the result that charging property is deteriorated, but it is better than with comparison example 2. The toner is introduced into the charging-promotion particles m stored in the housing container 22*b* of the charging-promotion particle supply device 22, but the toner contamination of the charging-promotion particle supply device 22 is suppressed low because of the proper charging of the toner. As a result, the toner recycling is accomplished while maintaining the direct charging with high property. In addition, the improper charging of the residual toner pattern on the drum as observed in the case of the printer of comparison example 2, does not occur, and it is understood that refreshing of the charging roller 21 is effected by the furbrush 22*c*.

(5) in the printer of Embodiment 3, the charging roller 21 is refreshed by the furbrush 22*g*, so that charging-promotion particles are exchanged, and the toner is stirred, and in addition, the charging-promotion particles m are deposited by the stirring member 22*h*, and therefore, the charging property is maintained.

(6) in the printer of Embodiment 4, the stirring of the charging-promotion particles m by the stirring member 22*h* is first carried out, and the charging-promotion particles m are deposited on the charging roller 21, and then, the charging roller is refreshed with the deposition charging promotion particles by the furbrush 22*g*, and therefore, the charging property is slightly deteriorated, but the charging system is operated with stability, and therefore, the charging property is maintained.

(7) in the printer of Embodiment 5, the stirring of the charging-promotion particles m, refreshing of the charging roller 21 and the deposition and supply of the charging-promotion particles m to the charging roller 21 are carried out by the swinging furbrush 22*g*, so that charging property is maintained similarly to Embodiment 4.

Embodiment 6

Figure 10:
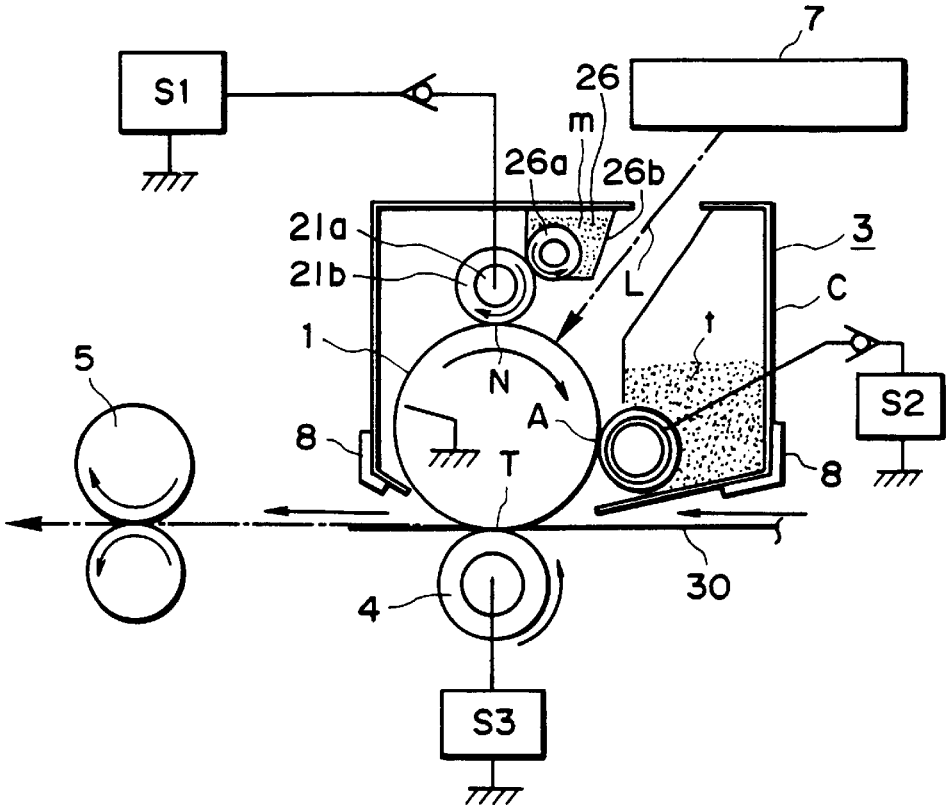
FIG. 10 is a schematic view of an image forming apparatus according to Embodiment 6.

In this embodiment, a different charging-promotion particle supplying means is used, as shown in FIG. 10. More particularly, an elastic foam roller is used in place of the furbrush of Embodiment 2. Additionally, the printer comprises a process cartridge detachably mountable to the main assembly of the printer. The other structures are the same as with the printer of Embodiment 2, and therefore, the detailed description of the common parts are omitted for simplicity.

Designated by C is a process cartridge detachably mountable relative to the main assembly of the printer. In the embodiment, the process cartridge contains four process means, namely, the photosensitive drum 1, the charging roller 21, the developing device 3 and the charging-promotion particle supplying means 26, and the process cartridge is detachably mountable relative to the main assembly of the printer. The combination of the process means contained in the process cartridge is not limited to those. Designated by 8, 8 are guiding and holding members for guiding and holding when the process cartridge is mounted to or demounted from the main assembly of the printer.

The charging-promotion particle supplying means 26 of this embodiment includes a roller 26*a* as a charging-promotion particle applying member and a housing 26*b* containing the charging-promotion particles m, and the roller 26*a* is disposed in the housing 26*b* with a part thereof exposed to the outside, and is contacted to the charging-promotion particles m in the housing 26*b*. And the exposed portion of the roller 26*a* is contacted to the surface of the charging roller 21. The particles m supplied to the charging roller 21 is supplied to the nip N by the rotation of the roller 21.

The charging-promotion particle application roller 26*a* is preferably of foam member or a member having unsmoothnesss on the surface thereof, more particularly, for example, urethane foam. EPDM foam or the like.

In this embodiment, the use is made with a charging-promotion particle application roller 26*a* of an urethane foam roller concentric with a rotation shaft thereof and having an outer diameter of 10 mm and a width (measured in the longitudinal direction thereof) of 250 mm. In this embodiment, the charging-promotion particle application roller 26*a* of the charging-promotion particle supplying means 26 is contacted to the charging roller 21, and the application roller 26*a* is rotated at the speed of 150% of that of the charging roller 21 in the same direction as the charging roller 21, so that charging-promotion particles m in the housing 26*b* is applied to the charging roller 21.

Therefore, the application roller 26*a* is contacted to the charging roller 21, and the surface cell diameter of the charging roller 21 is approx. 20 $\mu$m, and the surface cell diameter of the application roller 26*a* is approx. 50 $\mu$m in this embodiment. The surface of the application roller 26*a* has a rougher surface than the charging roller 21, and this difference of the charging roller 21 between the roller 26*a* and the roller 21 is effective to make easier the deposition of the particles m from the roller 26*a* to the roller 21.

By application and supply of the charging-promotion particles to the charging roller 21 by the charging-promotion particle supplying means 26, the charging-promotion particles can be supplied and supplied without adding means around the photosensitive drum, so that apparatus can be downsized. With this structure, even if the transfer efficiency is so decreased that untransferred toner is deposited to the surface of the charging roller, the charging-promotion particle application roller 26*a* can apply the charging-promotion particles while disturbing the residual image on the charging roller surface, and therefore, the production of the ghost image can be produced while maintaining the charging property.

By the counterdirectional rotation of the application roller 26*a* relative to the charging roller 21, the disturbance of the untransferred toner and the applying effect of the charging-promotion particles are improved. In place of the application roller 26*a*, a fixed foam member is usable.

Others

1) The structures of the charging roller 2 (flexible contact charging member) are not limited to a charging roller. The flexible contact charging member may be in the form of a furbrush, felt or textile in the material and configuration. Or, they may be laminated to provide proper elasticity and/or electroconductivity.

It is preferable to apply the charging-promotion particles to the contact charging member beforehand.

The movement directions of the charging roller and the drum may be the same in the charging nip.

2) When the charge bias applied to a contact type charging member 21 or the developing bias applied to a development sleeve 3*a* may be in the form of an AC biased DC voltage, wherein the waveform of the alternating voltage is optional; the alternating wave may be in the form of a sine wave, a rectangular wave, a triangular wave, or the like. Also, the alternating current may be constituted of an alternating current in the rectangular form which is generated by periodically turning on and off a DC power source. In other words, the waveform of the alternating voltage applied, as the charge bias, to a charging member or a development member may be optional as long as the voltage value periodically changes.

3) The choice of the means for exposing the surface of an image bearing member to form an electrostatic latent image does not need to be limited to the laser based digital exposing means described in the preceding embodiments. It may be an ordinary analog exposing means, a light emitting element such as a LED, or a combination of a light emitting element such as a fluorescent light and a liquid crystal shutter. In other words, it does not matter as long as it can form an electrostatic latent image correspondent to the optical information of a target image.

4) The use may be made with a surface charge injection layer in the photosensitive member (member to be charged) to control the resistance of the photosensitive member surface.

Figure 8:
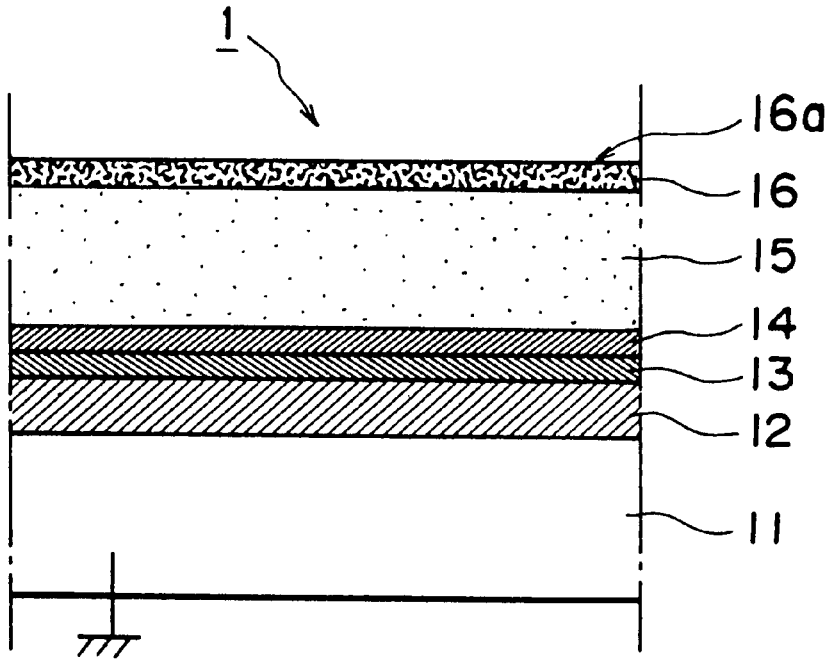
FIG. 8 is a schematic view of the layer structure of an example of a photosensitive member having a charge injection layer on the surface thereof.

FIG. 8 is a schematic view of the layer structure of a photosensitive member 1 having a surface charge injection layer 16. The photosensitive member 1 comprises, as in a known organic photosensitive member, an aluminum drum base (Al drum base) 11, a liner layer 12 thereon, a positive charge injection preventing layer 13 thereon, a charge generating layer 14 thereon and a charge transfer layer 15, and a charge injection layer 16 is applied on the organic photosensitive member to improve the charging property.

As for the charge injection layer 16, SnO2 ultra-fine particles 16*a*, having a diameter of approx. 0.03 $\mu$m, as electroconductive particles (electroconductive filler), lubricant such as tetrafluoroethylene resin material (tradename of Teflon), polymerization initiator and the like are mixed and dispersed in photo-curing type acrylic resin material as a binder, and the mixture are applied and formed into a film through photo-curing method.

The resistance of the surface layer is important from the standpoint of function of the charge injection layer 16. In the charging system using the direct injection of the charge, the charge is efficiently moved if the resistance of the member to be charged is lowered. On the other hand, from the standpoint of the function of the photosensitive member, it is required to keep the electrostatic latent image for a predetermined period of time, and therefore, the volume resistivity of the charge injection layer 16 is preferably $1\times10^{9}$–$1\times10^{14}$ (Ωcm).

In the case of not using the charge injection layer 16 as in this embodiment, the equivalent effects are provided if the charge transfer layer 15 has the resistance in the above range.

The same advantages are provided when the use is made with an amorphous silicon photosensitive member or the like having a volume resistivity of approx. $10^{13}$ Ωcm.

5) The image bearing member may be an electrostatic recording dielectric member or the like. In such a case, the dielectric member surface is uniformly charged (primary charging) to a predetermined polarity and potential, and thereafter, the selective discharging is effected by discharging needle head, electron gun or another discharging means to form an intended electrostatic latent image.

6) The developing means 3 used in the foregoing embodiments, is a reverse development device with one component magnetic toner, but the developing device structure is not limited to that. It may be a regular developing device.

7) The recording material which receives the toner image from the image bearing member may be an intermediary transfer member such as transfer drum or the like.

8) One example of a method for measuring the size of toner particles is as follows. A measuring apparatus is a Coulter counter TA-2 (product of Coulter Co., Ltd.) To this apparatus, an interface (product of NIPPON KAGAKU SEIKI) through which the values of the average diameter distribution and average volume distribution of the toner particles are outputted, and a personal computer (Canon CX-1), are connected. The electrolytic solution is 1% water solution of NaCl (first class sodium chloride).

In measuring, 0.1–5 ml of surfactant, which is desirably constituted of alkylbenzene sulfonate, is added as dispersant in 100–150 ml of the aforementioned electrolytic solution, and then, 0.5–50 mg of the toner particles are added.

Next, the electrolytic solution in which the toner particles are suspended is processed approximately 1–3 minutes by an ultrasonic dispersing device. Then, the distribution of the toner particles measuring 2–40 microns in particle size is measured with the use of the aforementioned Coulter counter TA-2, the aperture of which is set at 100 microns, and the volumetric average distribution of the toner particles is obtained. Finally, the volumetric average particle size of the toner particles is calculated from the thus obtained volumetric average distribution of the toner particles.

While the invention has been described with reference to the structures disclosed herein, it is not confined to the details set forth and this application is intended to cover such modifications or changes as may come within the purposes of the improvements or the scope of the following claims.

What is claimed is:

1. A charging apparatus comprising:

a movable charging member for being supplied with a voltage to charge a member to be charged, said charging member having, at its surface, a foam member for forming a nip with the member to be charged; and electroconductive particle supplying means, having a brush contactable to the foam member, for supplying electroconductive particles to the foam member.

2. An apparatus according to claim 1, wherein said electroconductive particles have a volume resistivity not more than $10^{12}$ Ωcm.

3. An apparatus according to claim 1, wherein said electroconductive particles have a volume resistivity not more than $10^{12}$ Ωcm.

4. An apparatus according to claim 1, wherein said brush is rotatable.

5. An apparatus according to claim 1, wherein said brush is swingable forward and backward along longitudinal direction of said charging member.

6. An apparatus according to claim 1, wherein said supplying means includes a housing for housing said brush and a stirring member for stirring said electroconductive particles in the housing.

7. An apparatus according to claim 1, wherein said supplying means includes a regulating member for regulating an amount of said electroconductive particles to be supplied to said charging member.

8. An apparatus according to claim 1, wherein said charging member is in the form of a roller.

9. An apparatus according to claim 1, wherein the brush includes fur or fiber.

10. An apparatus according to any one of claims 1–9, wherein said charging member effects injection charging to said member to be charged at the nip.

11. An image forming apparatus comprising:

a member to be charged for carrying a toner image;

a movable charging member for being supplied with a voltage to charge said member to be charged, said charging member having, at its surface, a foam member for forming a nip with the member to be charged;

developing means for developing with toner an electrostatic image formed on said member to be charged, using charging operation by said charging member; and electroconductive particle supplying means, having a brush contactable to the foam member, for supplying electroconductive particles to the foam member.

12. An apparatus according to claim 11, wherein said electroconductive particles have a volume resistivity not more than $10^{12}$ Ωcm.

13. An apparatus according to claim 11, wherein said electroconductive particles have a volume resistivity not more than $10^{10}$ Ωcm.

14. An apparatus according to claim 11, wherein said brush is rotatable.

15. An apparatus according to claim 11, wherein said brush is swingable forward and backward longitudinal direction of said charging member.

16. An apparatus according to claim 11, wherein said supplying means includes a housing for housing said brush and a stirring member for stirring said electroconductive particles in the housing.

17. An apparatus according to claim 11, wherein said supplying means includes a regulating member for regulating an amount of said electroconductive particles to be supplied to said charging member.

18. An apparatus according to claim 11, wherein said charging member is in the form of a roller.

19. An apparatus according to claim 11, wherein the brush includes fur or fiber.

20. An apparatus according to any one of claims 11–19, wherein said charging member effects injection charging to said member to be charged at the nip.

21. An apparatus according to any one of claims 11–19, wherein said developing means is capable of removing the toner from said member to be charged.

22. An apparatus according to claim 21, wherein said developing means is capable of simultaneously effecting developing operation of developing the electrostatic image with the toner and cleaning operation of removing the toner from said member to be charged.

23. An apparatus according to claim 11, wherein said member to be charged is provided with a surface layer having a volume resistivity of $1\times10^{9}$–$1\times10^{14}$ Ωcm.

24. An apparatus according to claim 23, wherein said member to be charged is provided with an electrophotographic photosensitive layer inside said surface layer.

25. An apparatus according to claims 1 or 11, wherein a speed difference is provided between a surface of the member to be charged and the foam member.

* * * * *

UNITED STATES PATENT AND TRADEMARK OFFICE

CERTIFICATE OF CORRECTION

PATENT NO. : 6,233,419 B1
DATED : May 15, 2001
INVENTOR(S) : Yasunori Chigono et al.

It is certified that error appears in the above-identified patent and that said Letters Patent is hereby corrected as shown below:

Title page,
Item [57] ABSTRACT,
Line 7, "particles" should read -- particle --.

Column 1,
Line 9, "charted" should read -- charged --;
Line 30, "charted." should read -- charged. --; and
Line 48, "eh" should read -- the --.

Column 2,
Line 20, "mechanim" should read -- mechanism --;
Line 51, "are" should read -- area --.

Column 3,
Line 64, "disclosed" should read -- discloses --.

Column 4,
Line 6, "coverge" should read -- converge --;
Line 12, "used" should read -- uses --;
Line 19, "Ac" should read -- AC --;
Line 22, "examples," should read -- example, --; and
Line 43, "type" should read -- types --.

Column 5,
Line 46, "charge," should read -- charged, --; and
Line 63, "has" should read -- have --.

Column 6,
Line 11, "sued" should read -- used --;
Line 16, "reduce" should read -- reduced --; and
Line 30, "higher" should read -- high --.

Column 10,
Line 19, "which" should be deleted.

Column 11,
Line 17, "functions" should read -- functions as --.

Column 12,
Line 40, "such" should read -- is such --.

UNITED STATES PATENT AND TRADEMARK OFFICE

CERTIFICATE OF CORRECTION

PATENT NO. : 6,233,419 B1
DATED : May 15, 2001
INVENTOR(S) : Yasunori Chigono et al.

It is certified that error appears in the above-identified patent and that said Letters Patent is hereby corrected as shown below:

Column 13,
Line 16, "charge" should read -- charging --; and
Line 46, "functions" should read -- function --.

Column 14,
Line 48, "transfer," should read -- transfer; --.

Column 15,
Line 49, "particles," should read -- particles --; and
Line 50, "provided" should read -- provided, --.

Column 16,
Line 2, "$10^5$/mm2" should read -- $10^5/mm^2$ --; and
Line 29, "are" should read -- area --.

Column 18,
Line 3, "log" should read -- long --.

Column 26,
Line 26, "backward" should read -- backward in a --.

Signed and Sealed this

Fifteenth Day of January, 2002

*Attest:*

*Attesting Officer*

JAMES E. ROGAN
*Director of the United States Patent and Trademark Office*